United States Patent [19]

Bell

[11] Patent Number: 4,979,713

[45] Date of Patent: Dec. 25, 1990

[54] TOWEL RACK MOUNTING MEANS

[75] Inventor: William F. Bell, Hayward, Calif.

[73] Assignee: Gatco, Inc., San Leandro, Calif.

[21] Appl. No.: 443,270

[22] Filed: Nov. 29, 1989

[51] Int. Cl.[5] ..... E04G 5/06

[52] U.S. Cl. ..... 248/224.3; 248/251

[58] Field of Search ..... 248/201, 224.3, 230, 248/224.2, 222.1, 251, 222.3, 220.2, 223.4; 403/362, 361; 211/16

[56] References Cited

U.S. PATENT DOCUMENTS

| | | | |
|---|---|---|---|
| 1,276,463 | 8/1918 | Wells | 248/222.1 |
| 1,940,888 | 12/1933 | Smith | 248/222.1 |
| 2,144,602 | 1/1939 | Balmer | 248/222.1 X |
| 2,176,644 | 10/1939 | Sladek | 248/222.1 |
| 2,506,602 | 5/1950 | Laystrom et al. | 248/222.1 X |
| 3,858,989 | 1/1975 | Field | 403/362 X |
| 4,223,861 | 9/1980 | Guggemos et al. | 248/251 X |
| 4,566,662 | 1/1986 | Toshishige | 248/222.1 |
| 4,662,593 | 5/1987 | Shames et al. | 248/201 X |

FOREIGN PATENT DOCUMENTS

| | | | |
|---|---|---|---|
| 0796532 | 4/1936 | France | 248/224.3 |

*Primary Examiner*—Ramon O. Ramirez

*Attorney, Agent, or Firm*—Limbach, Limbach & Sutton

[57] ABSTRACT

A towel rack mounting means including a triangular bracket which has three contacts with the interior of a circular base. The bracket has three flanges oriented in a triangular array. The round base is locked onto the bracket by screwing a threaded member through the wall of the base to contact one of the bracket flanges, causing the other two bracket flanges to engage a groove on the inner side of the base wall.

13 Claims, 1 Drawing Sheet

TOWEL RACK MOUNTING MEANS

BACKGROUND OF THE INVENTION

This invention relates to rack supports. More particularly the invention involves the use of a triangular bracket to mount the round base of a towel rack onto a vertical support.

Wall racks are frequently chosen for their artistic design or their aesthetic quality. Thus it has been an objective for inventors to design ways of securely mounting racks on walls with a minimum of screws or bolts externally exposed. Though the racks are often decorative, they usually have a utilitarian function. Therefore the hidden mount must be capable of supporting substantial weight and resisting forces from any direction, which would otherwise be capable of dislodging the rack from the vertical support.

Prior inventions have commonly employed a bracket which, when mounted, is hidden from view by a base of the rack. The base is secured to the bracket by a single headless screw which penetrates a wall of the base to contact the bracket. The problem has been to make such a mount strong enough to withstand the forces which are likely to be exerted on it.

Wall fixtures such as towel racks are frequently located in small rooms where there is much activity, making it common for the rack to be inadvertently bumped from any or all directions. Prior inventors have focused their attention on designing rack mounting means which resist gravitational forces applied to the objects which are hung from or placed on the racks. Whereas the present invention addresses the additional need for the rack to be able to equally resist forces from any direction.

The strength of the support depends on the relationship between the bracket and the base. Therefore the geometry of the base, chosen for its aesthetic qualities, frequently dictates what bracket configuration will provide the strongest support.

Rack bases have been designed in various shapes. For example U.S. Pat. Nos. 4,566,662, 2,506,602 and 1,9I5,479 teach methods for mounting substantially rectangular bases onto vertical supports. The brackets for these mounting means are similarly rectangular and usually have two contacts to the base. One contact is made by a screw through a wall of the base, and the other contact is made between a bracket flange and an interior portion of the base. These rectangular brackets, however, are not appropriate for mounting circular bases. Therefore other mounting configurations have been designed.

A typical mounting means for a circular base is taught in U.S. Pat. No. 2,059,858. The bracket is circular having a rectangular projection which is beveled at one end and flat at the opposite end. The beveled end conforms to a cavity in the interior of the base. A screw penetrates a wall of the base contacting the flat end of the projection, urging the beveled end of the projection into the cavity of the base accomplishing the mount. This mounting design may be adequate for resisting forces which directly counter the beveled end of the projection. However, since there are only two contacts between the bracket and the base, the fixture is susceptible to being dislodged from the support by lateral forces.

Other examples of prior mounting means capable of being used with circular bases are disclosed in U.S. Pat. Nos. 1,970,473 and 1,940,888. These patents teach the use of a round bracket capable of being received in a round cavity in the base. The bracket is then forced to engage a wall of the cavity by screwing a screw through the wall of the base. When mounted, there are only two contacts between the bracket and the base. Therefore these circular mounting means suffer from the same problem as the others discussed above. The mounts fail to adequately resist lateral forces which are commonly caused by inadvertently bumping or pulling an object from the rack.

It is an object of this invention to provide a means for mounting the round base of a rack onto a vertical support, the mounting means being strong enough to reliably support items which may be placed onto or hung from the rack, and to withstand forces from any direction which would otherwise dislodge the rack from the vertical support.

Another object of the invention is to provide a means for mounting the round base of a rack onto a vertical support, the mounting means being substantially hidden from view so that the aesthetic quality of the rack is unaffected.

SUMMARY OF THE INVENTION

The above mentioned objectives are accomplished by a mounting device comprised of a triangular bracket which has three contacts with the interior of a circular base. The bracket has a planar portion to be fastened against a vertical support. The bracket also has first, second and third flanges extending from the planar portion, each flange contacting the interior of the circular base. The first and second flanges have arcuate edges to compliment the curvature of a groove in the circular base. The base is locked onto the bracket by screwing a threaded member through a hole in the base, contacting the third flange to urge the first and second flanges into locking engagement with the interior groove of the base.

It will be evident from the following detailed description of the preferred embodiment and the claims, that the claimed invention is not limited to towel racks or to wall mounts. The invention is useful for attaching virtually any type of round structure to a support surface.

DETAILED DESCRIPTION OF THE DRAWINGS

Figure 1:
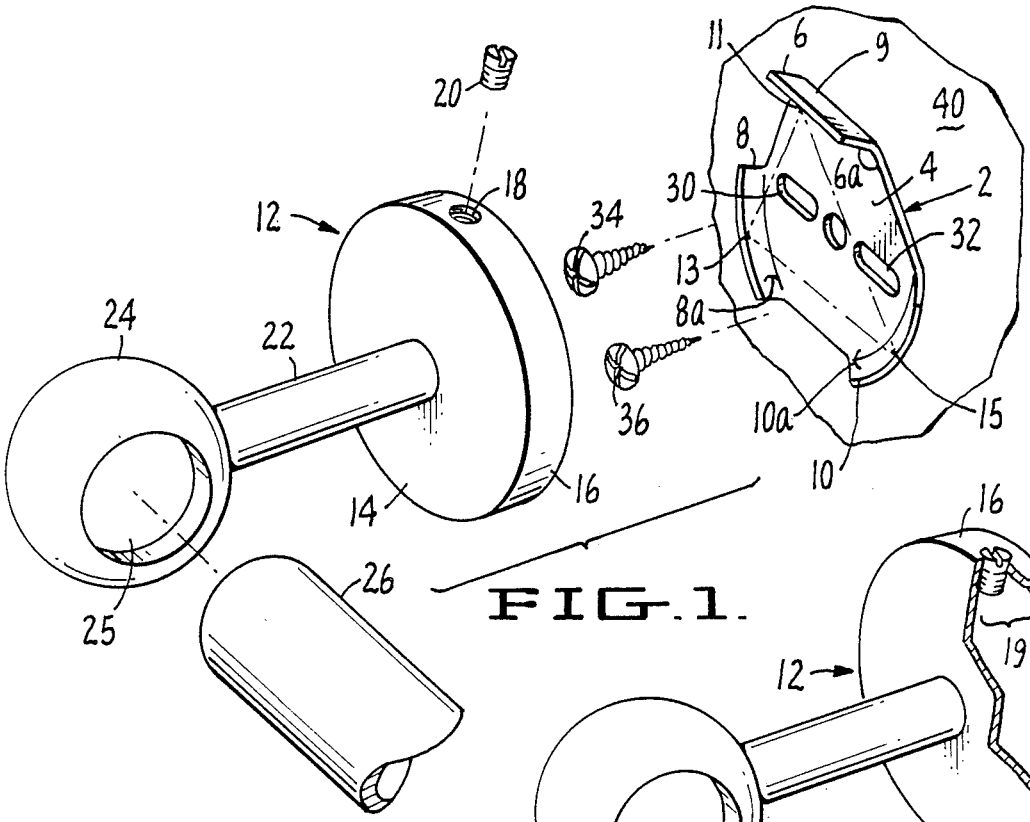
FIG. 1 is a perspective exploded view of the present invention.

A preferred embodiment of the present invention as shown in FIG. 1, includes a substantially triangular bracket 2 having a planar portion 4 connected to three flanges 6, 8 and 10. When mounted, the planar portion 4 of the bracket 2 is in a plane parallel to the vertical support 40. Flanges 6, 8 and 10 project out of the plane of the planar portion 4, forming obtuse angles **6*a*, 8*a* and 10*a* with the planar portion 4 of the bracket 2**. Flanges 8 and 10 have arcuate distal edges. The flanges 6, 8 and 10 have midpoints 11, 13 and 15 on their distal edges. In a preferred embodiment midpoints 11, 13 and 15 form an equilateral triangle, thus providing a uniform distribution of support around the bracket. The bracket 2 is provided with holes 30 and 32 dimensioned to receive screws 34 and 36 to secure bracket 2 against the vertical support 40.

Figure 3:
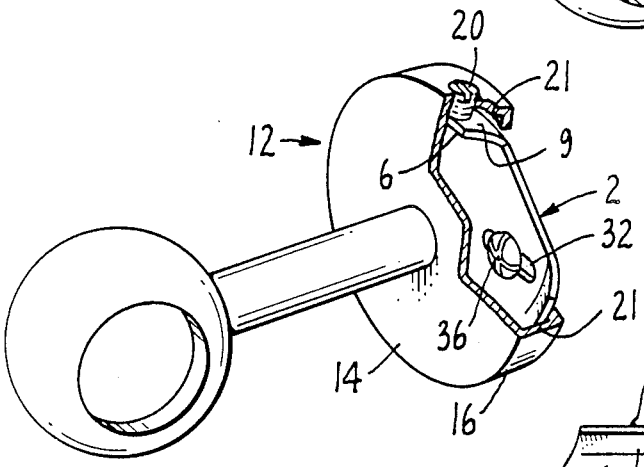
FIG. 3 is a perspective cut-away view of the present invention.
Figure 4:
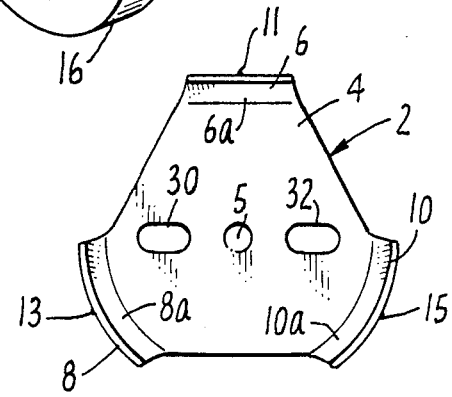
FIG. 4 is a front view of the bracket of the present invention.
Figure 5:
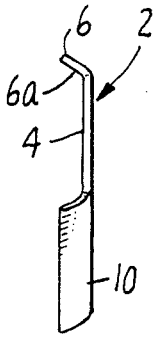
FIG. 5 is a side view of the bracket of the present invention.

When mounted, the bracket 2 is hidden from view by a circular base 12, as shown in FIG. 3. The base 12 has a bottom portion 14 and a round wall 16. The wall 16 of the base 12 is large enough to receive the bracket 2. The wall 16 of the base 12 has an interior surface 19. The interior surface 19 has a groove 21 dimensioned to receive arcuate flanges 8 and 10. Other embodiments could employ a separate screw for engaging each flange 6, 8 and 10, avoiding the need for the groove 21 on the interior surface 19 of the wall 16 of the base 12. The wall 16 of the base 12 is also provided with a threaded hole 18 dimensioned to receive threaded member 20. The base 12 is forced into locking engagement with the bracket 2 by screwing the threaded member 20 through the wall 16 of the base 12 to contact the outer surface 9 of the flange 6, thereby urging arcuate flanges 8 and 10 into the groove 21 on the interior surface 19 of the wall 16 of the base 12.

Figure 2:
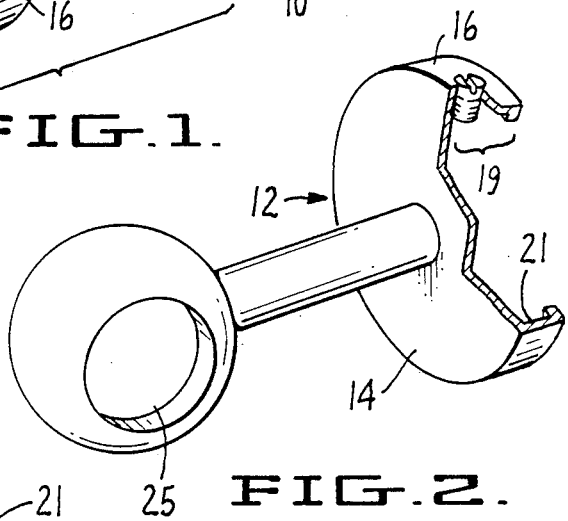
FIG. 2 is a perspective cut-away view of the base and arm of the present invention.

An arm 22, as shown in FIGS. 1,2 and 3, is connected to the bottom 14 of the base 12, projecting away from the mounting wall 40. The end of the arm 22 distal from the mounting wall 40 is provided with a spherical nob 24. The nob 24 has a hole 25 adapted to receive a bar 26.

Although the present invention has been shown and described with respect to preferred embodiments, changes or modifications which are obvious to a person skilled in the art are considered to be within the scope of this invention.

What is claimed is:

1. A device for mounting a rack on a vertical support comprising:

(a) a bracket adapted to be secured on said vertical support, said bracket having first, second and third contact members, oriented in a substantially triangular array;

(b) a circular base attached to said rack, said base having a bottom portion and a round wall, said wall having an interior surface, said interior surface being substantially perpendicular to said support when mounted; and (c) locking means for forcing first and second contact members of said bracket, into contact with said interior surface of said wall of said base, so that said base is fixed against said vertical support and is capable of resisting forces from any direction.

2. The device according to claim 1 wherein, each of said contact members is a flange having a distal edge, said bracket having a planar portion to be secured in a plane parallel with said vertical support, each of said flanges extending out of said plane away from said vertical support forming an obtuse angle with said planar portion of said bracket.

3. The device according to claim 2 wherein, each of said distal edges of said flanges has a midpoint, said midpoints of said flanges forming an equilateral triangle.

4. The device according to claim 1 wherein, said interior surface of said wall of said base has a groove adapted to receive said distal edges of said first and second flanges of said bracket.

5. The device according to claim 4 wherein said distal edges of said first and second flanges are arcuate to compliment the curvature of said round wall of said base.

6. The device according to claim 5 wherein, said locking means includes, a threaded member, said wall of said base having a threaded hole adapted to receive said threaded member, said third flange of said bracket having an outer surface for contacting said threaded member, so that as said threaded member is screwed into said wall of said base in contact with said outer surface of said third flange, said first and second flanges are forced into locking engagement with said groove on said interior surface of said wall of said base, securely fastening said base onto said vertical support.

7. The device according to claim 6 further comprising at least one more device as claimed in claim 6, said mounting devices being positioned in series to receive and support said rack in at least two points.

8. A device for mounting a rack on a wall comprising:

(a) a bracket having a planar portion to be secured in a plane parallel to said wall, said bracket having first, second and third flanges connected to said planar portion, said flanges having distal edges, said distal edges of said first and second flanges being arcuate, each of said flanges extending out of said plane away from said wall forming an obtuse angle with said planar portion of said bracket, each of said flanges having a midpoint on its distal edge, said midpoints of said flanges forming an equilateral triangle;

(b) a base having a bottom portion and a round wall said wall having an inner diameter large enough to encompass said bracket, said wall having an interior surface, said interior surface having a groove dimensioned to receive said arcuate distal edges of said first and second flanges of said bracket;

(c) locking means for urging said first and second flanges of said bracket into engagement with said groove in said base including, a threaded member, said wall of said base having a threaded hole adapted to receive said threaded member, said third flange of said bracket having an outer surface for contacting said threaded member, so that as said threaded member is screwed into said wall of said base in contact with said outer side of said third flange, said first and second arcuate flanges are forced into locking engagement with said groove on said inner surface of said wall of said base, securely fastening said base to said wall.

9. The device according to claim 8, further comprising:

(a) means for supporting and connecting said rack to said base, including an arm having first and second ends, said first end being attached to said bottom of said base, said second end being positioned distally from said vertical support and having a spherical nob, said nob having a hole dimensioned to receive said rack.

10. A device for mounting a rack on a planar support, comprising:

(a) a base attached to said rack, said base having a generally circular wall, said wall being substantially perpendicular to said planar support;

(b) a bracket having first, second and third flanges oriented in a substantially triangular array, each of said first and second flanges having a distal edge;

(c) locking means for urging each of the distal edges of said first and second flanges of said bracket into contact with said wall of said base, so that each of said flanges is engaged with said base and said rack is secured to said planar support.

11. The device according to claim 10, wherein, (a) said wall of said base has a substantially uniform curvature, and each of said distal edges of said first and second flanges has an arcuate curvature, said curvature of said base wall being substantially equal to said curvature of each of said distal edges of said first and second flanges, so that the amount of contact between the distal edges of said first and second flanges and said wall of said base is maximized.

12. The device according to claim 11, wherein, said locking means includes:

a threaded member, said wall of said base having a threaded hole adapted to receive said threaded member, said hole and said threaded member being registered with said third flange on said bracket, so that as said threaded member penetrates said hole in said wall of said base, said threaded member contacts said third flange urging each of said distal edges of said first and second flanges into contact with said wall of said base.

13. The device according to claim 12, wherein, said locking means includes:

a projection extending inwardly from said wall of said base, said base having a planar portion which is substantially parallel to said planar support, so that when said bracket and base are located, each of said first and second flanges are disposed between said projection and said planar portion of said base.

* * * * *

UNITED STATES PATENT AND TRADEMARK OFFICE

CERTIFICATE OF CORRECTION

PATENT NO. : 4,979,713

DATED : December 25, 1990

INVENTOR(S) : William F. Bell

It is certified that error appears in the above - identified patent and that said Letters Patent is hereby corrected as shown below:

In Col. 1, line 43, please delete "1,9I5,479" and replace with --1,915,479--.

In Col. 4, line 35, after "wall" insert --,--.

In Col. 6, line 17, delete "located" and replace with --locked--.

Signed and Sealed this

Thirtieth Day of June, 1992

*Attest:*

DOUGLAS B. COMER

*Attesting Officer*

*Acting Commissioner of Patents and Trademarks*